US007686750B2

(12) United States Patent
Tuller

(10) Patent No.: US 7,686,750 B2
(45) Date of Patent: Mar. 30, 2010

(54) SEATED ABDOMINAL EXERCISER

(76) Inventor: Jeff Tuller, 1424 Misty Sea Way, San Marcos, CA (US) 92078

( * ) Notice: Subject to any disclaimer, the term of this patent is extended or adjusted under 35 U.S.C. 154(b) by 0 days.

(21) Appl. No.: 11/809,002

(22) Filed: May 30, 2007

(65) Prior Publication Data

US 2007/0287619 A1 Dec. 13, 2007

Related U.S. Application Data

(60) Provisional application No. 60/809,561, filed on May 31, 2006.

(51) Int. Cl.
*A63B 26/00* (2006.01)

(52) U.S. Cl. ..... 482/142; 482/123; 482/51

(58) Field of Classification Search ..... 482/140, 482/142, 139, 62, 51, 121–123, 92, 95–96
See application file for complete search history.

(56) References Cited

U.S. PATENT DOCUMENTS 5,533,953 A * 7/1996 Lui et al. ..... 482/96
5,582,563 A 12/1996 Fan et al.
5,669,865 A * 9/1997 Gordon ..... 482/142
6,022,304 A 2/2000 Tornabene et al.
6,387,024 B1 * 5/2002 Monti et al. ..... 482/142
6,491,611 B1 12/2002 Stearns
7,125,366 B1 * 10/2006 Yeh ..... 482/140
7,179,212 B2 * 2/2007 Hsiung et al. ..... 482/140
2003/0130100 A1 * 7/2003 Perez ..... 482/140
2005/0130816 A1 * 6/2005 Huang ..... 482/140
2006/0116261 A1 * 6/2006 Hsiung et al. ..... 482/140
2007/0259760 A1 * 11/2007 Perez ..... 482/140

* cited by examiner

*Primary Examiner*—Lori Amerson
(74) *Attorney, Agent, or Firm*—Patton Boggs LLP

(57) ABSTRACT

An abdominal exerciser in which the body floats with respect to the exerciser frame, which leads to isolating the abdominal muscles. The exerciser includes a seat; a frame adapted to support said seat in a position that is raised off a floor; a seat pivot connecting said seat and frame, said pivot located under said seat; an upper body arm adapted to engage the upper body of a user; an upper body arm pivot connecting said seat and said upper body arm; and a lower body arm attached to said seat.

19 Claims, 13 Drawing Sheets

SEATED ABDOMINAL EXERCISER

CROSS-REFERENCE TO RELATED APPLICATIONS

This Application is a Non-Provisional Application of Provisional (35 USC 119(e)) Application No. 60/809,561 filed on May 31, 2006.

FIELD OF THE INVENTION

The invention relates to fitness exercises, and more particularly to an abdominal exerciser that is used in a seated position.

BACKGROUND OF THE INVENTION

Abdominal exercises have always been important in exercise routines. Because saggy waistlines are considered to be particularly unattractive, abdominal exercises have become very important to men and women interested in looking their best. A variety of abdominal exercisers having seats are known. See, for example, U.S. Pat. No. 5,582,563 issued Dec. 10, 1996 to Robert Fan; U.S. Pat. No. 6,022,304 issued Feb. 8, 2000 to Dean Tornabene and Charles Perez; and U.S. Pat. No. 6,491,611 issued Dec. 10, 2002 to Kenneth W. Stearns. All of these exercisers are designed to exercise a wide range of other muscles in addition to the abdominal muscles. In fact, these exercisers are usually promoted as having the advantage that a variety of muscles may be exercised, and/or that they provide a complete workout. However, this is, in fact, a disadvantage to persons who desire to focus their workout on the abdomen, since it lengthens the time it takes to build the abdominals. In addition, all of these exercisers significantly stress the lower back, which often becomes a chronic source of pain for persons who are otherwise fit. Thus, it would be desirable to have a seated abdominal exerciser that permits the user to focus the exercise on the abdominal muscles and, thus, shorten the exercise period needed to have a trim waistline and at the same time reduce the stress on the lower back.

BRIEF SUMMARY OF THE INVENTION

The present invention advances the art and overcomes the aforementioned problems by providing a seated abdominal exerciser in which the body floats with respect to the exerciser frame, which leads to isolation of the abdominal muscles. Here, "float" means that the lower body and upper body are not constrained to move in any particular path by the frame, but rather the legs and body naturally move as though the user was doing the abdominal exercise while floating in water or space.

The invention provides an exerciser comprising: a seat; a frame adapted to support the seat in a position that is raised off a floor; a seat pivot pivotably connecting the seat and frame, the pivot located under the seat; an upper body arm adapted to engage the upper body of a user; an upper body arm pivot pivotably connecting the seat and the upper body arm; and a lower body arm adapted to engage the lower body of a user, the lower body arm attached to the seat. Preferably, the exerciser further includes a leverage bar attached to the upper body arm and a constraint mechanism adapted to constrain movement of the leverage bar with respect to the frame in at least one direction while not constraining movement in another direction. Preferably, the exerciser further includes an adjustment mechanism permitting the relative positions of the leverage bar and the upper body arm to be adjusted.

Preferably, the constraint mechanism is attached to the frame. Preferably, the constraint mechanism comprises a first roller and a second roller, and the leverage bar is movably trapped between the first roller and the second roller. Preferably, the upper body arm is adapted to engage the chest of a user, and the lower body arm is adapted to engage the legs of a user. Preferably, the seat pivot is attached to the middle of the underside of the seat. Preferably, the upper body pivot is connected to the underside of the seat. Preferably, the upper body pivot is connected to the back of the seat. Preferably, the frame includes a back support.

The invention also provides a method of exercising the abdominal muscles of a human body, the method comprising: providing an exerciser having a frame, a seat, an upper body arm, and a lower body arm; sitting on the seat, engaging the upper body arm with the upper body of the human body, and engaging the lower body arm with the lower body of the human body; and, using the abdominal muscles, pivoting the upper body arm about an upper body arm pivot point near the seat while pivoting the seat with respect to the frame about a seat pivot point under the seat. Preferably, pivoting the upper body arm comprises pivoting about an upper body arm pivot point adjacent the seat. Preferably, the upper body arm pivot point is under the seat. Preferably, the upper body arm pivot point is behind the seat. Preferably, essentially only the abdominal muscles are used in the pivoting. Preferably, the method further comprises leveraging the upper body arm against the frame so that pivoting the upper body arm provides at least a portion of the force required to move the lower body. Preferably, the method further comprises adjusting the position of the upper body arm with respect to the point of the leveraging.

In another aspect, the invention provides a method of exercising the abdominal muscles of a human body, the method comprising: providing an exerciser having a frame, a seat, an upper body arm, and a lower body arm; sitting on the seat, engaging the upper body arm with the upper body of the human body, and engaging the lower body arm with the lower body of the human body; and, using essentially only the abdominal muscles, pivoting the upper body arm about an upper body arm pivot point while pivoting the seat with respect to the frame about a seat pivot point. Preferably, the method further comprises leveraging the upper body arm against the frame so that pivoting the upper body arm provides at least a portion of the force required to move the lower body. Preferably, the method further comprises adjusting the position of the upper body arm with respect to the point of the leveraging.

The invention for the first time provides a seated abdominal exerciser that isolates the abdominal muscles and prevents lower back ailments often associated with abdominal exercise. Numerous other features, objects, and advantages of the invention will become apparent from the following description when read in conjunction with the accompanying drawings.

DETAILED DESCRIPTION OF THE INVENTION

Figure 1:
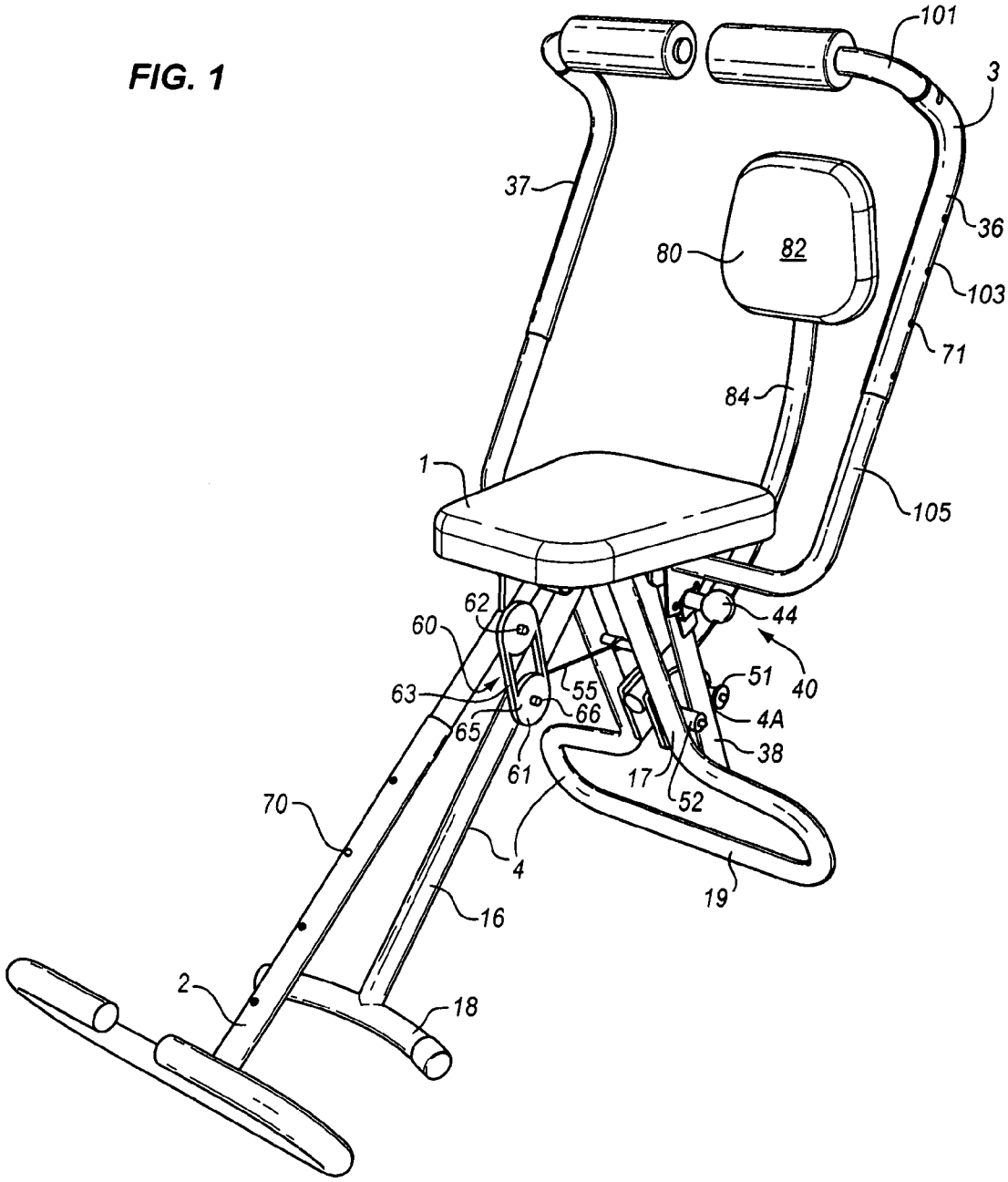
FIG. 1 is a front perspective view of the preferred embodiment of the abdominal exerciser according to the invention.
Figure 2:
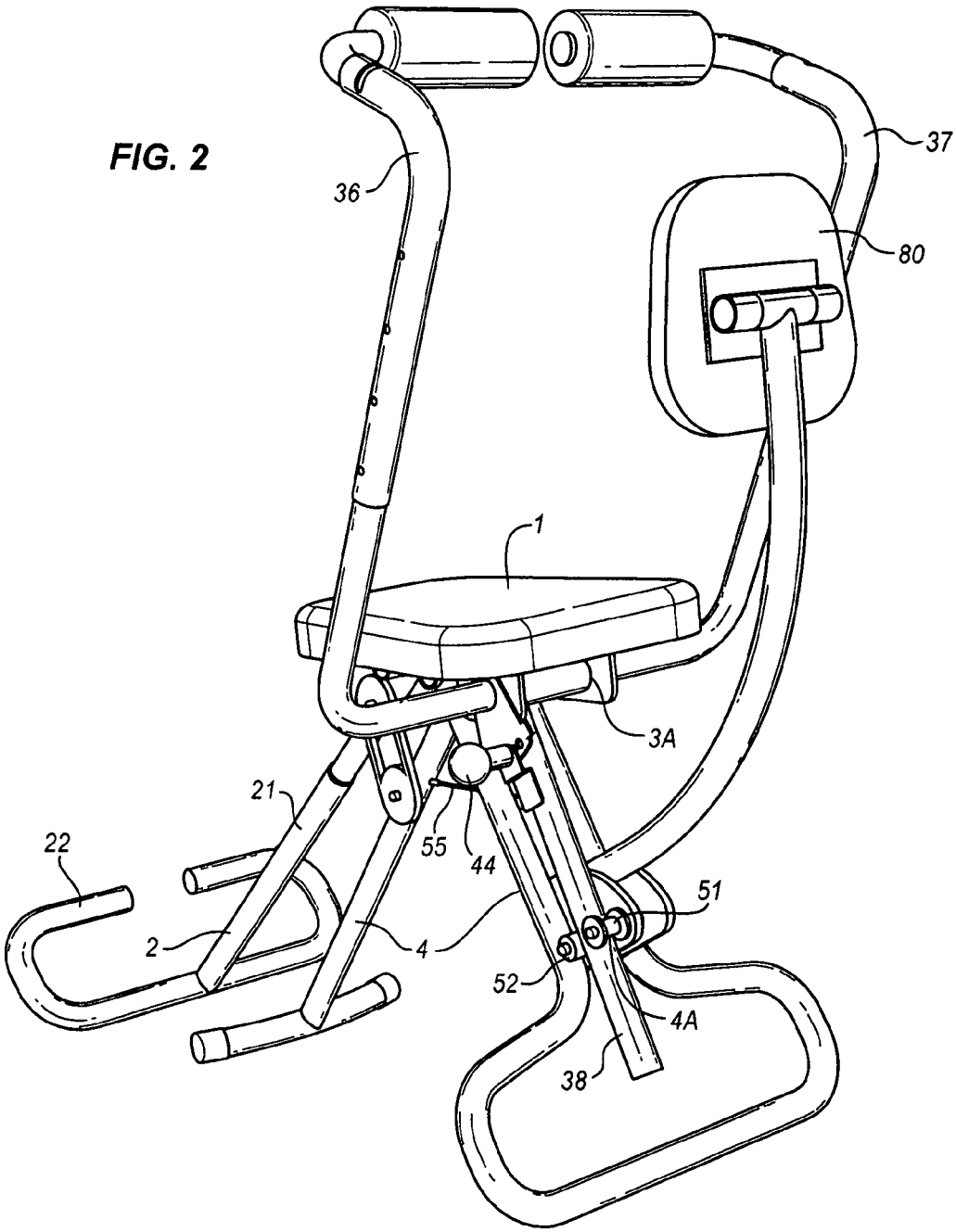
FIG. 2 is rear perspective view of the abdominal exerciser of FIG. 1.

Referring to FIGS. 1 through 5, the construction of the preferred embodiment consists of: a pivoting seat 10, having a pivot point 1A; a leg raise assembly 2, including a lower body arm 21, fastened to the pivoting seat 10; an upper body arm/leverage bar assembly 3 that fastens to the pivoting seat 10 via an independent pivot point 3A; and a support frame 4 which holds the pivoting seat 10 and provides a leverage point 4A (FIGS. 2 and 4) for the arms/leverage bar 3. Additional features allow for adjustment of the arms-to-leverage bar via adjustment assembly 40 to provide for different body sizes and which also permit the upper body arms/leverage bar to move backwards for back extension exercises; optional addition of variable resistance 60; various adjustments 70, 71 for different size bodies; and provisions for a back support 80. In this disclosure, an upper body arm is a structure that is adapted to engage the upper body of the user (that is, the part of the body above the waist), and a lower body arm is a structure adapted to engage the lower body of the user (that is, the part of the body below the waist).

Figure 3:
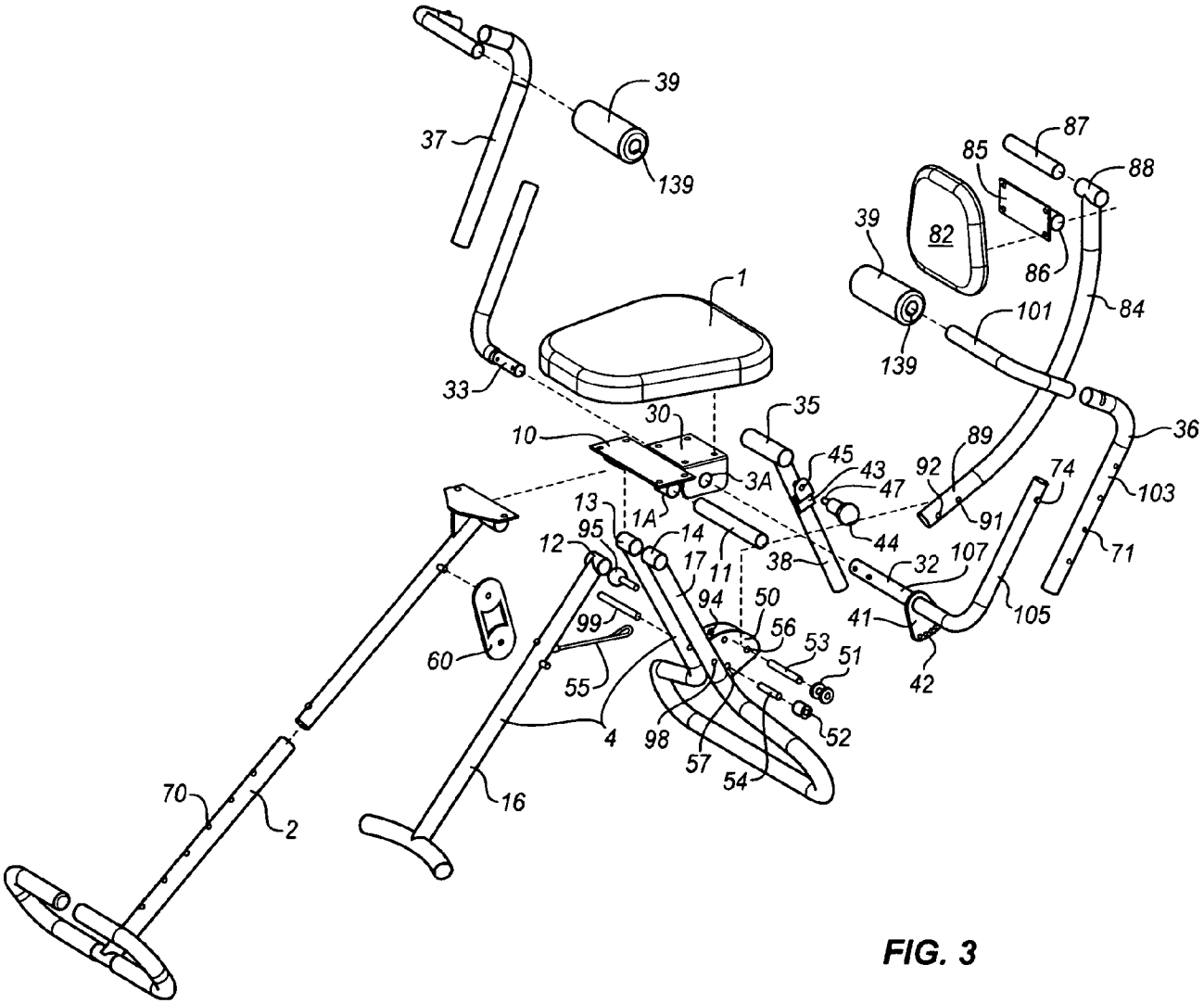
FIG. 3 is an exploded view of the abdominal exerciser of FIG. 1.
Figure 4:
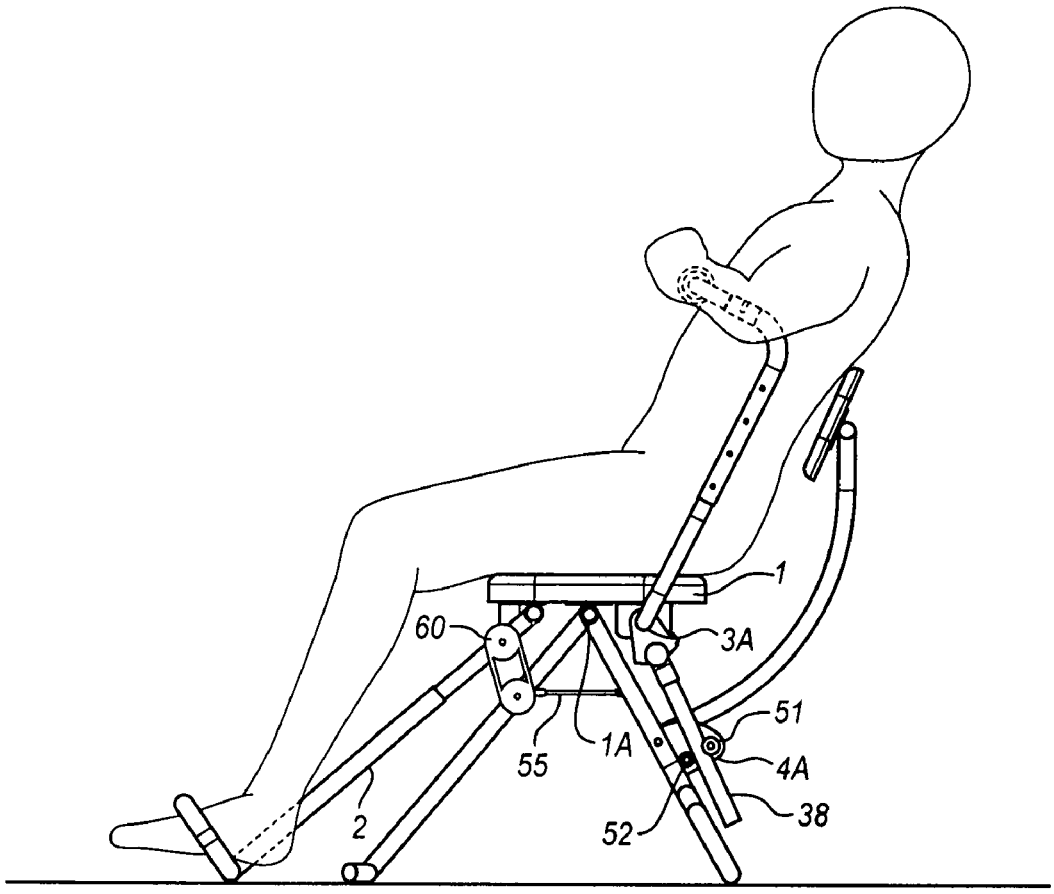
FIG. 4 illustrates a person using the exerciser of FIG. 1 in the initial position with abdominal muscles uncontracted.

A feature of the invention is that there are two independent pivot points 1A and 3A. The pivot points 1A and 3A are perhaps best seen in FIGS. 4 and 5. Referring to FIG. 3, a seat pivot bracket 10 and an upper body arm pivot bracket 30 are fastened to seat 1. A pivot bar 11 fits through pivot 1A in seat bracket 10 and also through pivot cylinders 12, 13, and 14 in the ends of legs 16 and 17 of frame 4. Ends 32 and 33 of arms 36 and 37, respectively, act as the pivot bar for pivot point 3A. Ends 32 and 33 pass through pivot point 3A in bracket 30 and through pivot cylinder 35 at the end of leverage bar 38. A related feature of the invention is that upper body arm/leverage bar assembly 3 is not directly attached to frame 4 but rather is attached via seat 1 and pivots 1A and 3A.

Figure 10:
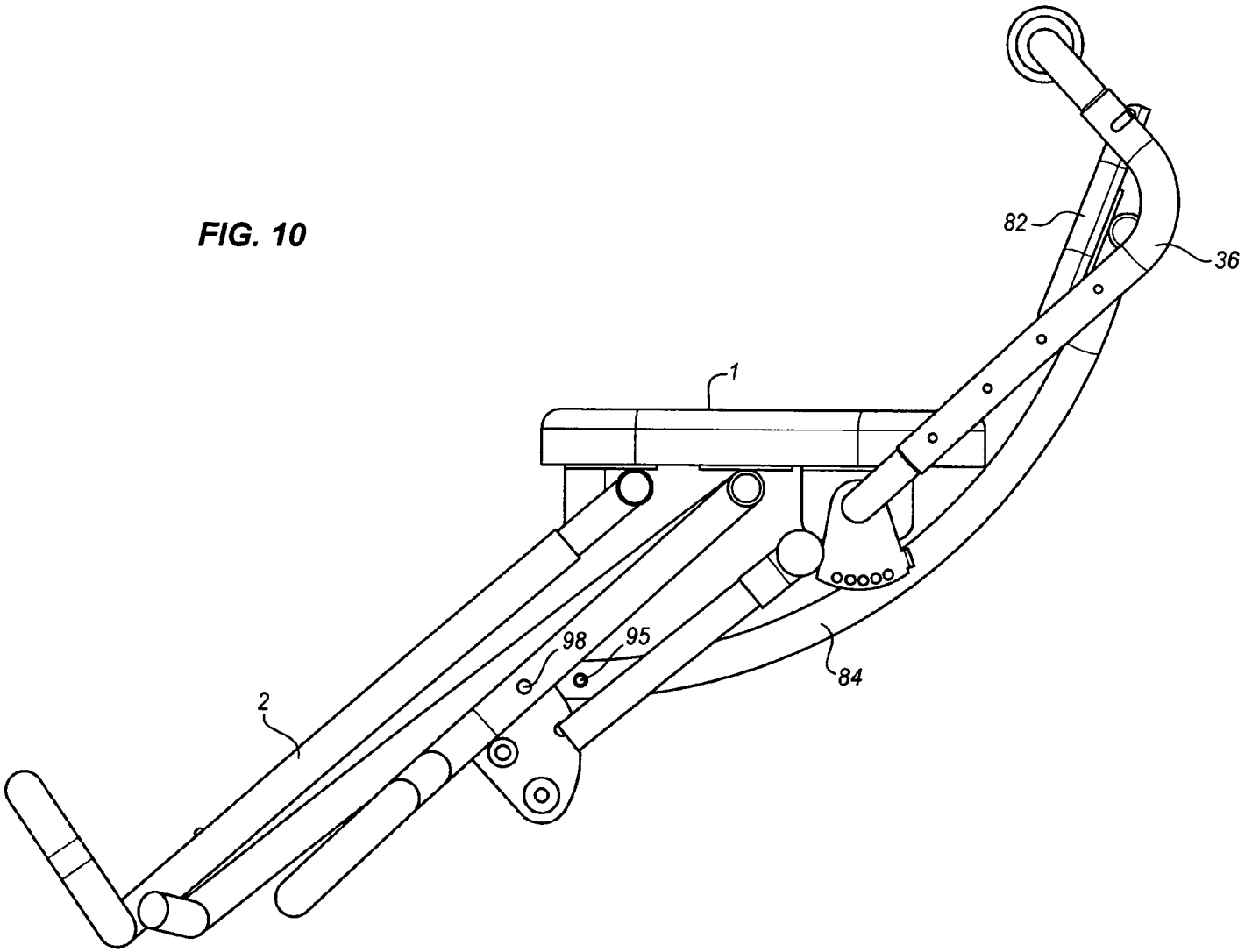
FIG. 10 shows the exerciser of FIG. 1 in a folded condition with the resistance mechanism removed.

Upper body arm/leverage bar assembly includes left arm 36, right arm 37, and leverage bar 38. Left arm 36 includes a cross arm 101, an arm extension 103, a connecting arm portion 105, and a pivot portion 107, while right arm 37 has corresponding portions. Pads 39 preferably have a cylindrical bore 139 which slides over cross arm portions 101. Leverage bar 38 includes bar 34 and pivot 35. Frame 4 includes legs 16 and 17 attached to feet 18 and 19, respectively, and back support 80. Back support 80 includes back pad 82, back support member 84, bracket 85, first pivot cylinder 86 fixed to bracket 85, second pivot cylinder 88 fixed to support member 88, and pivot pin 87. Back support 80 fits between the two sides of bracket 50 and pin 95 and passes through holes 91 in end 89 of back support member 80, while pin 99 that holds limiter cord 55 passes through hole 92 in back support element 84 and holes 98 in leg 17 to attach back support 80 to frame 4. Pin 95 can be removed to allow the frame to be folded (FIG. 10). Leg raise assembly 2 includes lower body arm 21 and foot grip 22.

Seat pivot 1A preferably is located under the seat, and most preferably centered under the seat. The combination of a seat pivot under the seat and an arm pivot 3A attached to the seat allows the body to float with respect to the frame and is important in isolating the abdominal muscles. Here, "float" means that the lower body and upper body are not constrained to move in any particular path by the frame, but rather the legs and body naturally move as though the user was doing the exercise while floating in water or space. The fact that the arm pivot 1A is attached to the seat and not the frame allows the lower body and upper body to crunch directly about the hips. Seat pivot 1A under seat 1 allows the pelvis to pivot naturally without creating additional non-rotational stresses that would otherwise be created and cause muscles other than the abdominals to become involved.

Figure 5:
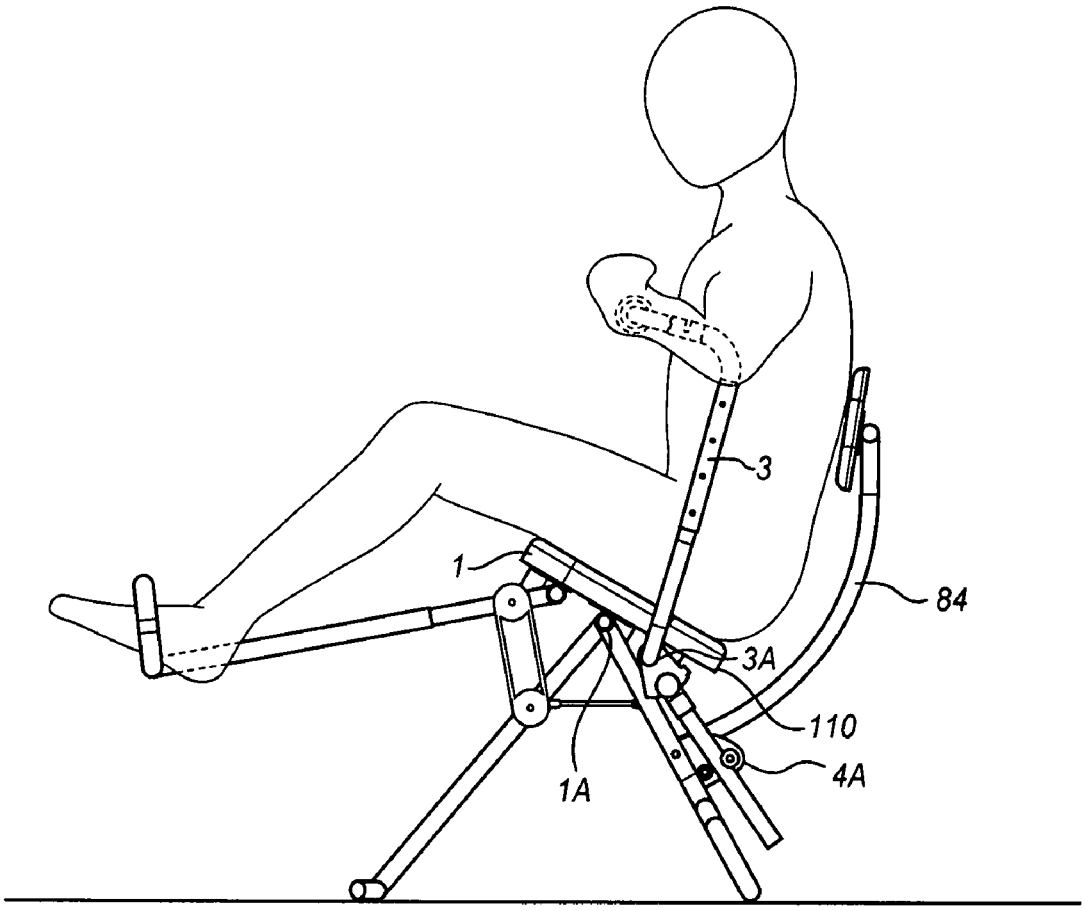
FIG. 5 illustrates a person using the exerciser of FIG. 1 with the abdominal muscles contracted.
Figure 6:
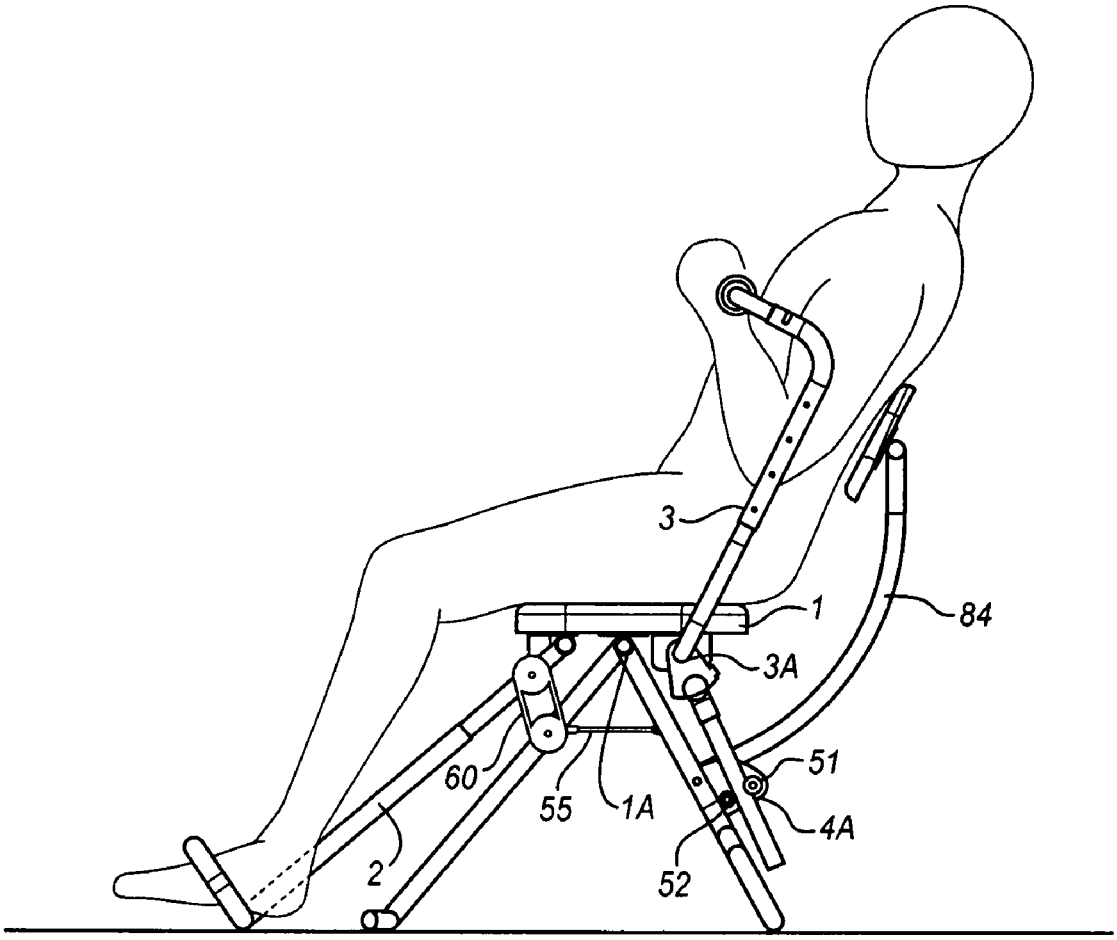
FIG. 6 illustrates another preferred body positioning for using the exerciser of FIG. 1 in the initial position with abdominal muscles uncontracted.
Figure 7:
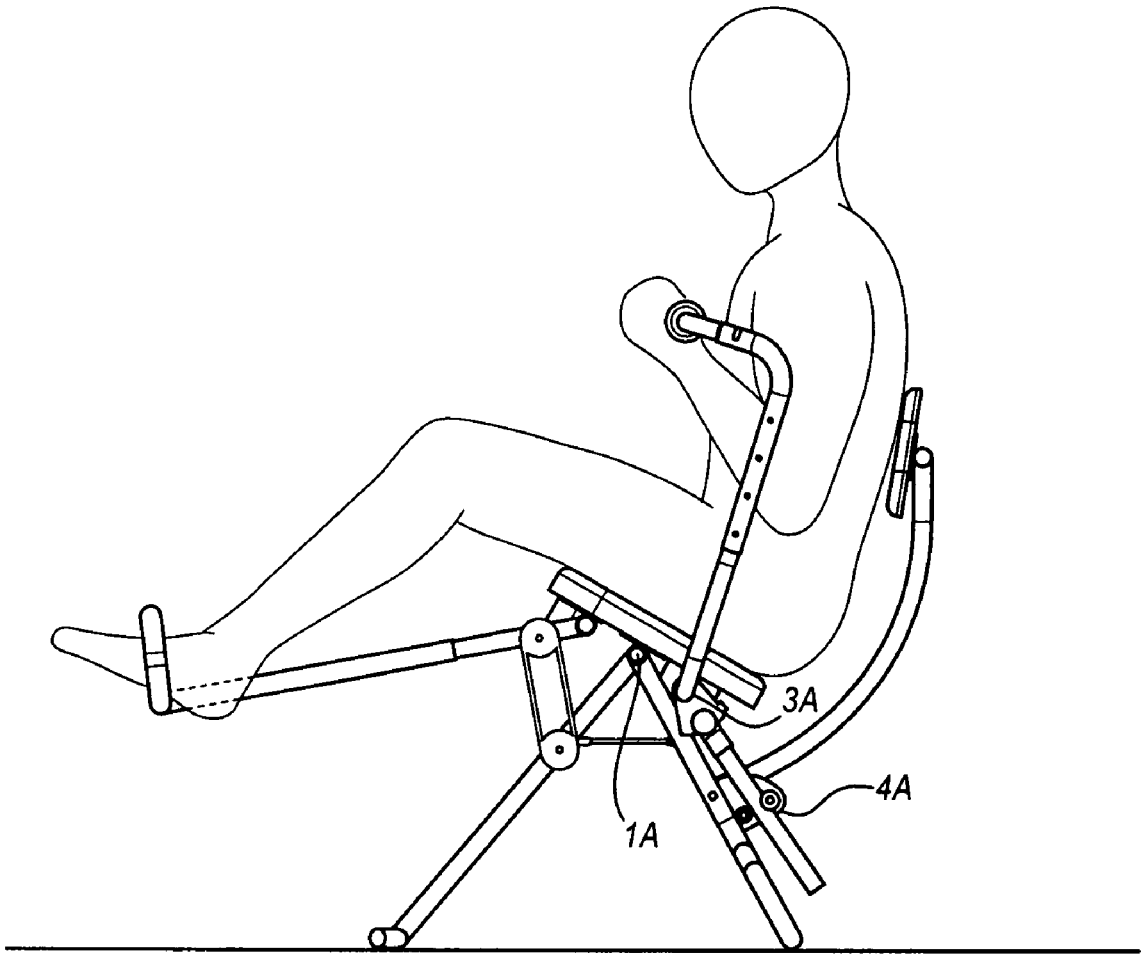
FIG. 7 illustrates the alternative body positioning of FIG. 6 with the abdominal muscles contracted.
Figure 8:
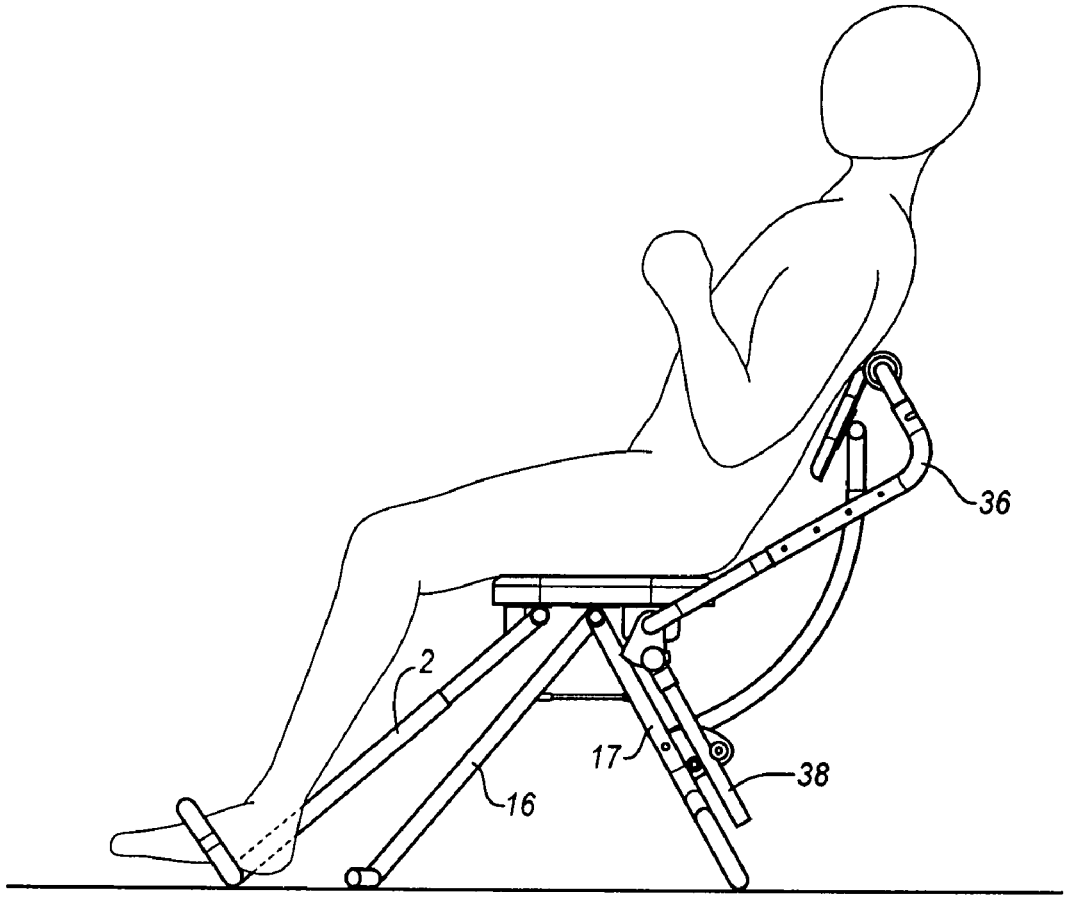
FIG. 8 illustrates an alternative positioning of the upper arms/leverage bar useful for performing back strengthening exercises with the user in the initial position with abdominal muscles uncontracted.
Figure 9:
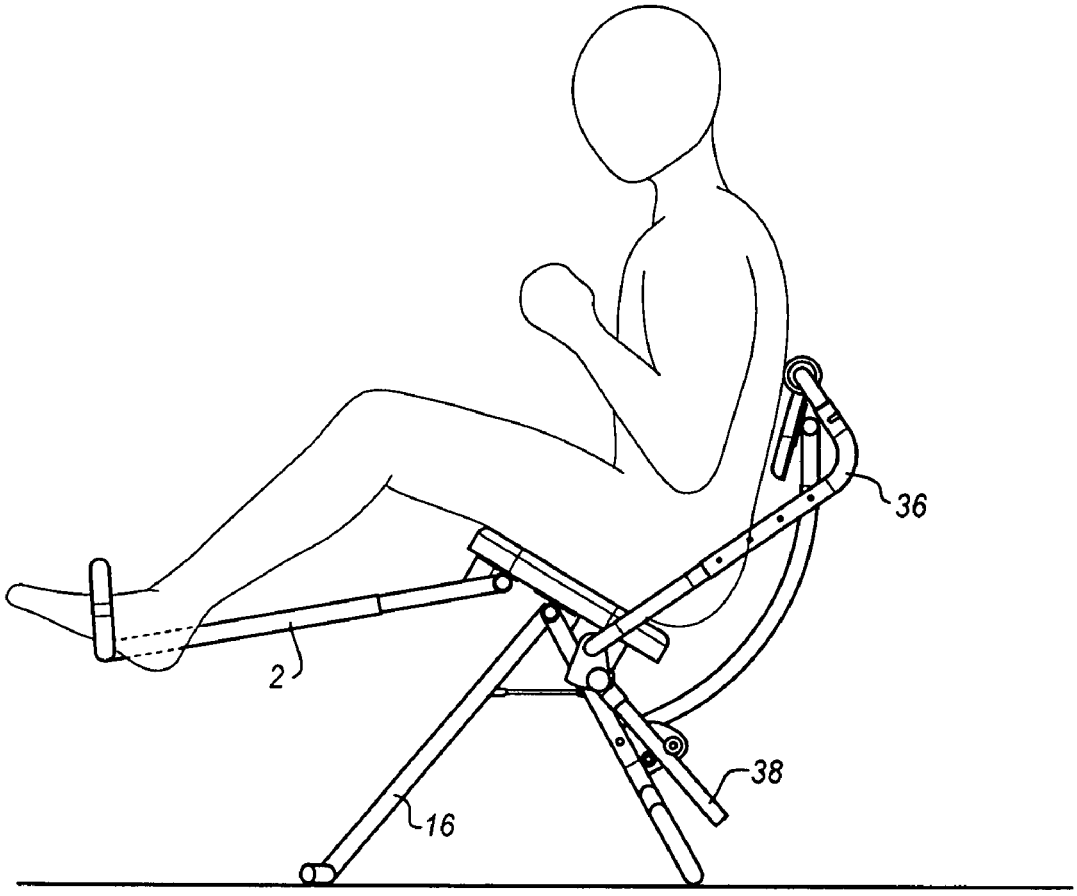
FIG. 9 illustrates the alternative exerciser positioning of FIG. 6 with the abdominal muscles contracted.

While the upper body's movement with respect to the lower body is not constrained by the frame, the frame does provide a moving leverage point 4A which creates resistance to the abdominal exercise via the body's own weight. The moving leverage point 4A is created by a roller constraint mechanism in the preferred embodiment, but it also may be a sliding mechanism. In the preferred embodiment, leverage arm 38 is constrained to roll between rollers 51 and 52 that rotate on pins 53 and 54 (FIG. 3), respectively. Pins 53 and 54 fit into holes 56 and 57, respectively, in bracket 50. The constraining action of rollers 51 and 52 on leverage bar 38 provides leverage against the weight of the user's legs. The backward tilt of the body in the initial position shown in FIG. 4 and the lowering of the rear 110 of seat 1 as shown in FIG. 5 also requires the user to lift the weight of the upper body as the exercise is performed. The position of arms 36 and 37 with respect to leverage bar 38 can be adjusted with arm/leverage bar adjustment assembly 40 best seen in FIG. 3. Adjustment assembly 40 includes bracket 41 having adjustment holes 42, bracket 43 having adjustment hole 45, and adjustment knob 44 having a pin 47 that passes through one of holes 42 into hole 45. When pin 47 is released, arms 36 and 37 can be moved with respect to leverage bar 38. This permits adjustment of arms 36 and 37 so that pads 39 rest against the chest of the user in the initial position. Alternatively, arms 36 and 37 can be moved behind the user as shown in FIGS. 8 and 9 to permit lower back exercises.

Added resistance mechanism 60 preferably comprises an elastic band 63 and a pair of elastic anchors 61 and 62 attached to frame leg 16 and lower body arm 21, respectively. Elastic anchors 61 and 62 preferably are rotatable wheels, such as 65, which rotate on axels, such as 66, to permit the elastic to adjust evenly between the two sides. Adjustment mechanism 70, 71 preferably comprises spring-loaded pins, such as 74 (FIG. 3) in lower body arm 21 and upper body arms 36 and 37 that permit these structures to be lengthened or shortened. Leg limiter 55 preferably comprises a flexible cable, rope, or other device, and pin 99 that fits into holes 98 in leg 17, which limiter 55 limits the width that legs 16 and 17 can spread apart but allows ease of folding of the exerciser.

Figure 11:
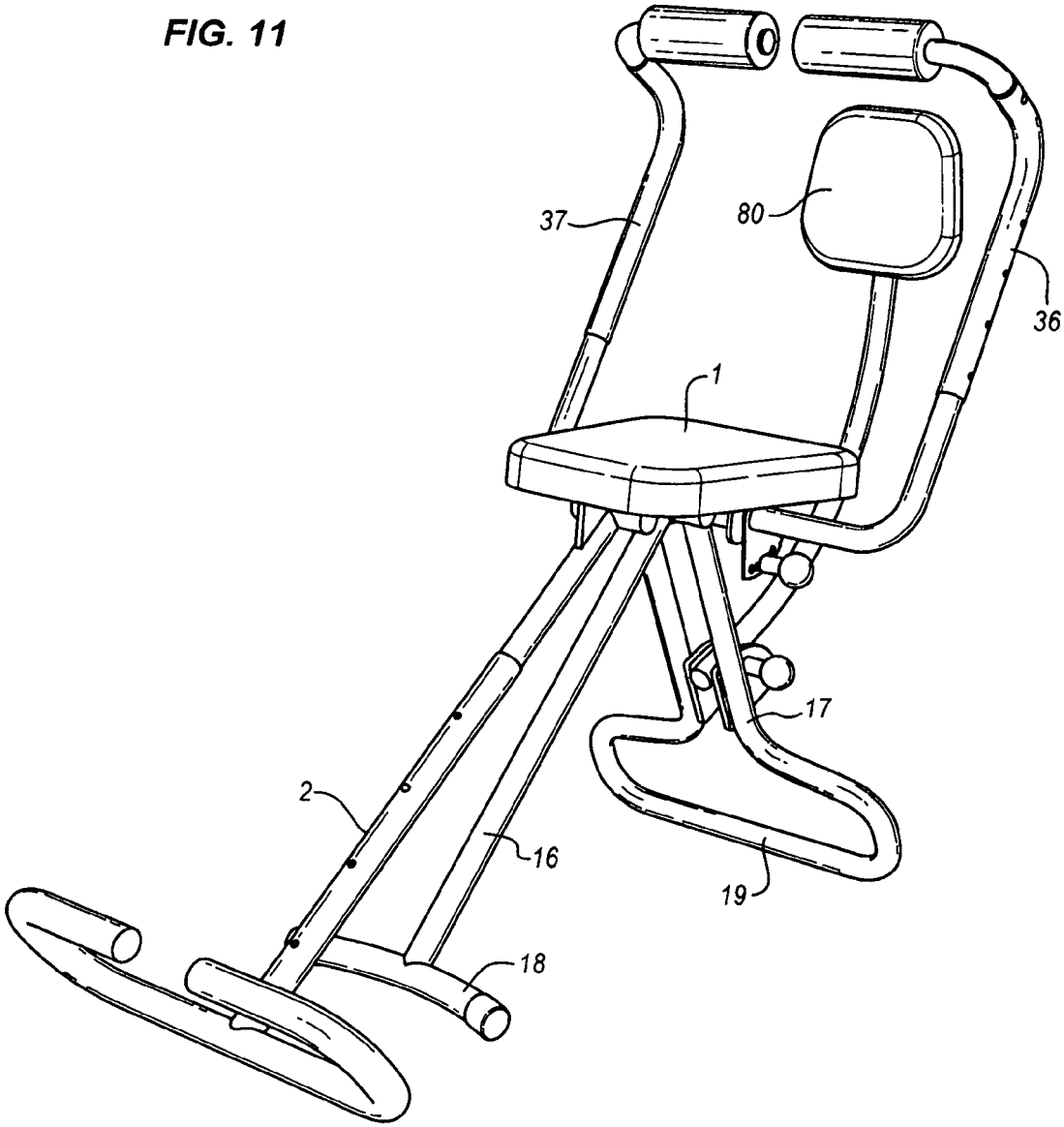
FIG. 11 shows a front perspective view of an alternative embodiment of the abdominal exerciser according to the invention.

FIG. 11 shows an embodiment of the invention that is similar to the embodiment of FIG. 1, except that no resistance mechanism 60 is utilized. The design of the invention permits significant resistance from the weight of the user's body alone. Since the weight of a person's body is often proportional to the person's strength, this feature results in a resistance that is variable depending on the person's weight, which often is also proportional to the person's strength.

Figure 12:
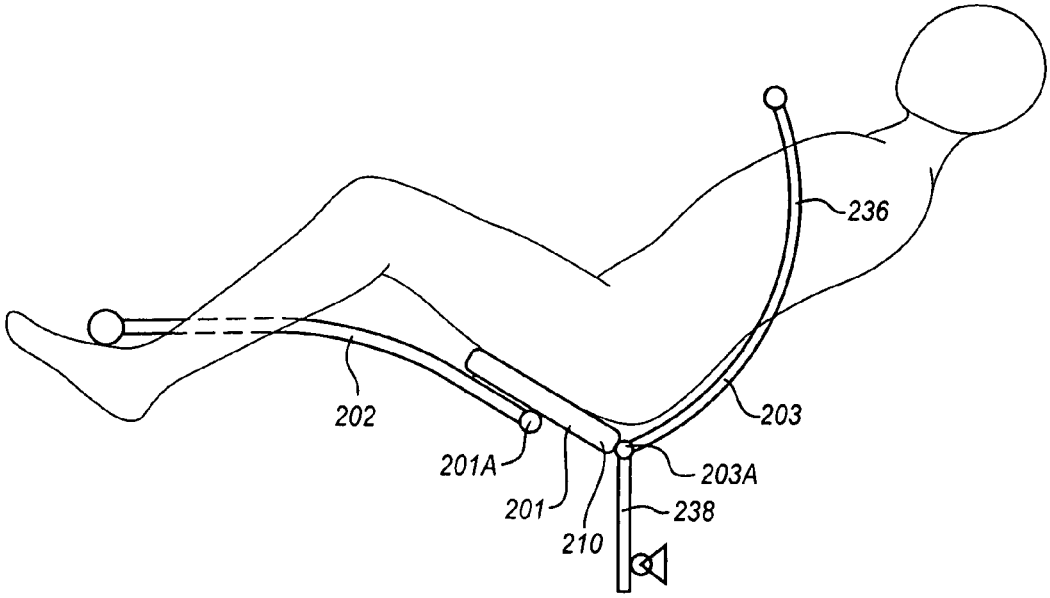
FIG. 12 illustrates the basic functional elements of an exerciser according to the invention.
Figure 13:
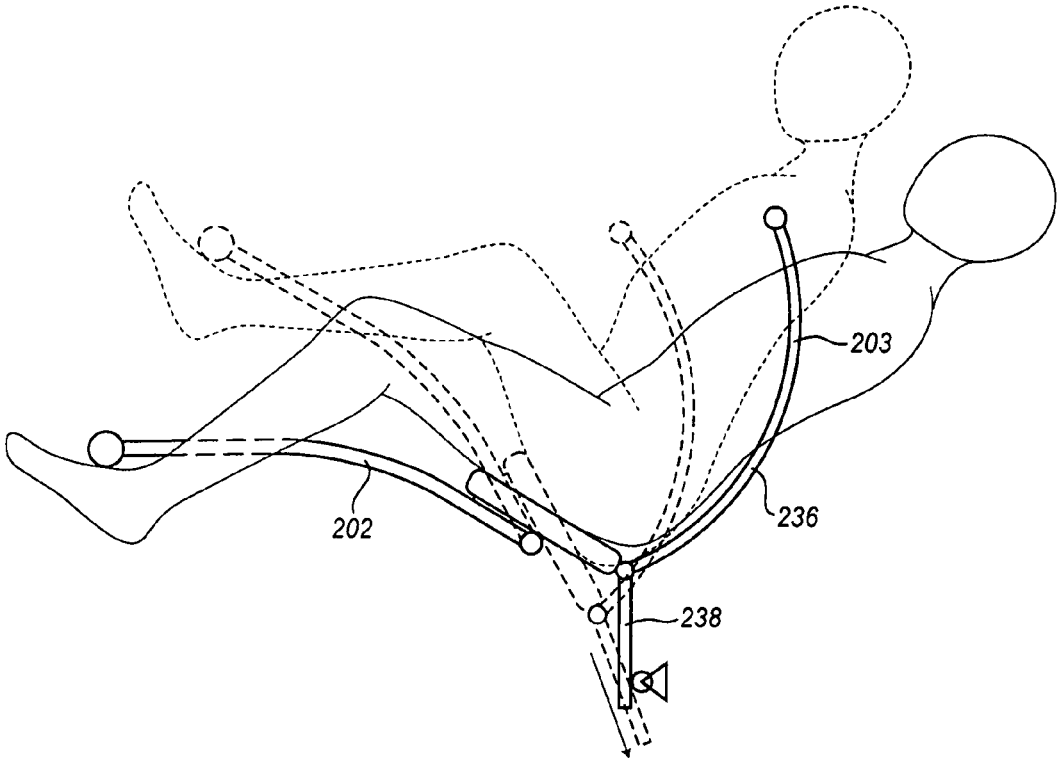
FIG. 13 illustrates the basic exercise motion using the functional elements of an exerciser according the invention.
Figure 14:
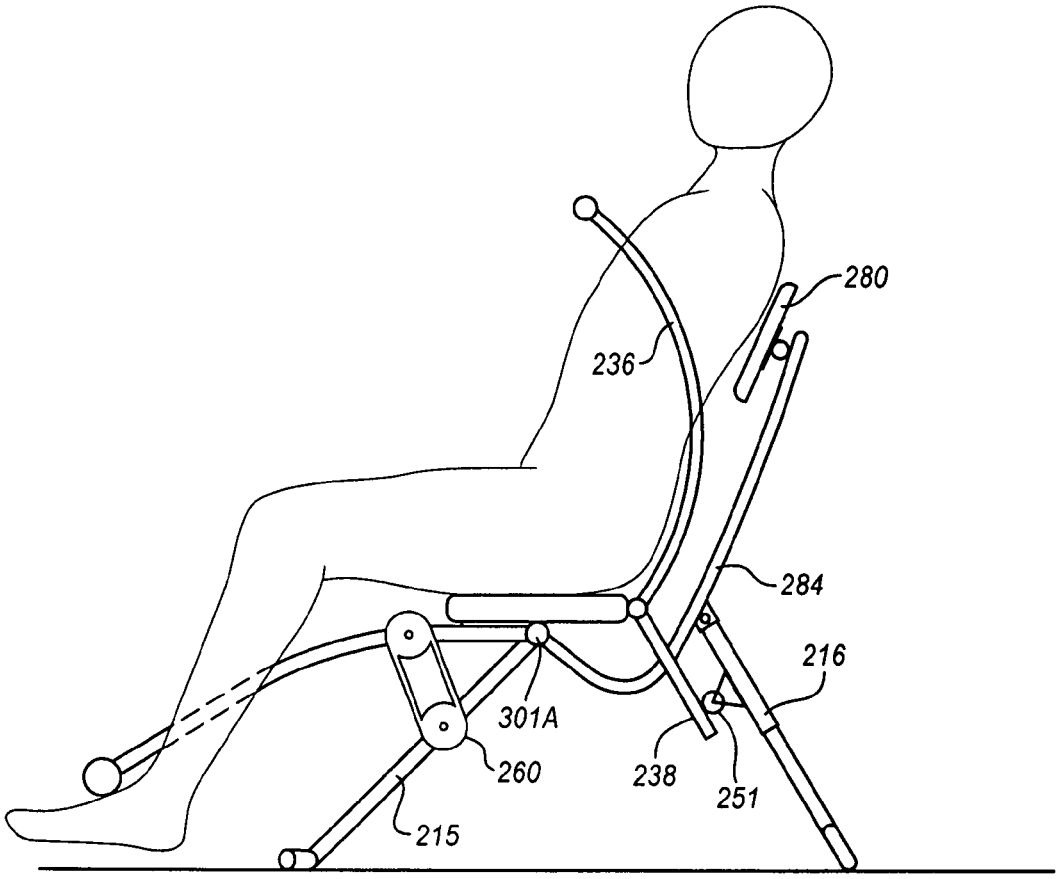
FIG. 14 illustrates the basic functional elements of an exerciser according to the invention with a resistance element.

FIGS. 12 through 14 illustrate another embodiment of the invention in which arm/leverage bar pivot 203A is attached to the rear 210 of seat 201. This embodiment is shown in a simplified drawing that more easily illustrates the principles of the invention. In this embodiment, leg raise bar 202 is attached to seat pivot 201A and arm/leverage bar assembly 203 is attached to pivot 203A, which is attached to the back 210 of seat 201. Arm/leverage bar assembly includes upper body arm 236 and leverage bar 238. As can be clearly seen, particularly in FIG. 13, leg raise bar 202 and arms 236 pivot freely with no constraint on their relative movement due to any attachment to the frame, which is not shown in these figures to better illustrate this feature. This isolates the abdominals. At the same time, leverage bar 203 provides leverage against constraint mechanism 251, which significantly increases the resistance due to the body weight. The embodiment of FIG. 14 is similar to that of FIGS. 12 and 13, except legs 215 and 216, resistance mechanism 260, and back support 280 are shown. In this embodiment, leg 215 is attached at seat pivot 301A and leg 216 is attached to back support element 284. Leg 216 is telescoping which permits it to be used to change the length of the back leg, thus, change the angle of the crunch and, thus, the resistance.

The basic operation of the unit is as follows. The user sits in the unit with feet resting in foot grip 22 of leg raise assembly 2 and with the upper end of the upper arms/leverage bar 3 resting against the user's chest. The user then contracts his abdominal muscles, thus creating a force against both the leg raise assembly 2, which begins to move upward, and against the upper part of arms 36, 37, which begin to move forward and down. Whether a predominate force is created against the leg raise assembly 2 and lower body arm 21, or a predominate force is created against the upper body arm bar 101, or an equal force placed on both simultaneously, the resultant movement is the same in all cases. As the leg raise or lower body arm travels upward, because the leg raise assembly 2 is connected to the seat 1, the seat 1 begins to pivot back. Location of the pivot under the seat is selected so that movement of the leg raise bar requires the user to work against his body weight (i.e., the user is lifting his legs up in a reverse crunch style against the force of gravity). Consequently, as the back of the seat pivots downward, this lowers the pivot point of the upper body arm/leverage bar. As the user creates force against the upper body arm/leverage bar, the crunching motion translates force onto the upper part of the upper body arm/leverage bar. Note that the user's chest is engaged to the upper body arm bar. The upper body arm/leverage bar provides a lever design, whereby the pivot point that is attached to the underside of the seat, or the back of the seat in an alternative embodiment, is the fulcrum, and the force that is applied to the upper arm bar is then translated against a roller, or sliding surface, that is attached to the support frame. The upper body arm/leverage bar is attached to the seat at the upper body arm/leverage bar pivot. However, it is not attached or connected to the support frame; instead, it is a floating lever that moves with the seat as the seat pivots downward in the back. As the back of the seat rotates downward, the leg bar rises in the front. Thus, whether one looks at the force being generated by the user's upper body, or at the force being generated by the user lifting/crunching the lower body upward, the resultant motion is the same. The physiology of the abdominal muscles is that the upper abdominals are attached to the rib cage, and the lower abdominals are attached to the pelvis. When the body is allowed to "float" (like an astronaut in outer space), then the abdominal muscles when contracted in isolation pull the front of the rib cage downward while the front of the pelvic bone tilts upward (known as posterior pelvic tilt). In this ideal state, the force created at both ends of the abdominal muscle is the same, and stress on the spine from other muscles, such as the hip flexors, is minimized. In contrast, if the invention is not used, when either the legs are constrained during a crunch, such as holding the legs down during a traditional sit-up, or the upper trunk is constrained during a leg lift, such as a straight leg raise when lying face up on the floor, then the iliopsoas muscles, which are attached to the lower spine, are incorporated into the movement; thus, increased stress is placed on the spine, as well as resulting in a less efficient abdominal workout.

This abdominal invention allows the body to "float" on the pivoting seat and facilitates the upper body trunk and lower body legs to contract towards each other causing the body to always perform a correct posterior pelvic tilt, thus, minimizing stress on the back, minimizing use of the hip flexors, as well as maximizing concentration of the exercise on the abdominal muscles. Other devices typically either have held the lower body fixed while the upper trunk crunches, or the upper trunk is stationary while the legs lift up, which consequently increases back stress at the expense of a less effective abdominal workout.

In addition to crunching straight forward, the user can also focus the exercise on the oblique abdominal muscles, i.e., the side abs. To perform the oblique exercises, the user simply lays both knees over to one side, and shifts the pelvis slightly on the seat, i.e., lays both knees to the right, and then the left side of the pelvis shifts forward slightly on the seat. The user then crunches in this position to work one side of the obliques, and then switches the knees to the other side to work the other side of the obliques.

The user also can perform lower back extension exercises by adjusting the upper arm bar towards the back of the unit, so that the user can lean his back against the upper arm bar, as shown in FIGS. 8 and 9. The resistance is also shifted to a position under the seat, so that the resistance causes the device to crunch in towards itself. In this position, the user pushes against the upper body arm bar with his back, and pushes down against the lower body or leg bar, which is against the resistance, thus, working the lower back muscles. By pulling out knob 44 while exercising, the arm/leverage bar can also be released so that it operates independently from the leg bar, so that just the upper back extension movements are performed while the feet remain stationary.

The invention allows the user to exercise and strengthen the abdominal muscles and central core muscles, including the side oblique abdominals and lower back muscles, while reducing stress on the back. The exercise is a seated abdominal crunch; therefore, it does not require the user to uncomfortably lie on the floor to perform standard abdominal crunches. The machine is designed to facilitate a complete abdominal crunch incorporating both the upper body crunch motion combined with the lower body pelvic tilt crunch motion, i.e., the upper body is crunching inward as the lower body is also crunching inward. Unlike other inventions, the unique seat rotation of the lower body relative to the upper body crunch motion requires the user's body to perform a proper pelvic tilt during the crunch motion. The pelvic tilt is critical for isolation of the abdominal muscles so that the hip flexor muscles are disengaged. Conversely, when hip flexors are engaged during an abdominal crunch, additional stress is created on the lower back, or lower spine, and the abdominal muscles are not trained as effectively.

A feature of the invention is that the upper body arm pivot point 3A, 203A is preferably near the seat 1, and more preferably adjacent the seat 1. Here, the term "near the seat" means that it is within eight inches of the seat, but more preferably within six inches of the seat. Most preferably, it is within four inches of the seat, and in the preferred embodiments is within two inches of the seat.

The exerciser according to the invention is made of known materials, such as aluminum, steel, or other suitable metal for the structural parts; plastic, fabric, or other suitable material for the seat and back; and metal or durable plastic for the rollers.

The particular systems, designs, methods, and exercises described herein are intended to illustrate the functionality and versatility of the invention, but the invention should not be construed to be limited to those particular embodiments. It is evident that those skilled in the art may now make numerous uses and modifications of the specific embodiments described; or equivalent structures and processes may be substituted for the structures and processes described; or different body positions may be used. Since certain changes may be made in the above systems and methods without departing from the scope of the invention, it is intended that all subject matter contained in the above description or shown in the accompanying drawings be interpreted as illustrative and not in a limiting sense. Consequently, the invention is to be construed as embracing each and every novel feature and novel combination of features present in or inherently possessed by the systems, methods, and routines described in the claims below and by their equivalents.

What is claimed as new and desired to be protected by Letters Patent of the United States is:

1. An exerciser comprising:

a seat;

a frame adapted to support said seat in a position that is raised off a floor;

a seat pivot pivotably connecting said seat and frame, said pivot located under said seat;

an upper body arm adapted to engage the upper body of a user;

an upper body arm pivot pivotably connecting said seat and said upper body arm;

a lower body arm adapted to engage the lower body of a user, said lower body arm attached to said seat, wherein when said upper body arm is oriented in front of said user, a pushing force, applied to said upper body arm, causes an end of said seat to pivot downward, wherein said end of said seat that pivots downwards is the end furthest from the lower body arm; and a leverage bar attached beneath said seat to said upper body arm and a constraint mechanism adapted to constrain movement of said leverage bar with respect to said frame in at least one direction while not constraining movement in another direction; wherein said constraint mechanism comprises a first roller and a second roller, and said leverage bar is movably trapped between said first roller and said second roller.

2. An exerciser as in claim 1, and further including an adjustment mechanism for positioning said leverage bar and said upper body arm for adjustment.

3. An exerciser as in claim 1 wherein said constraint mechanism is attached to said frame.

4. An exerciser as in claim 1 wherein said seat pivot is attached to the middle of the underside of said seat.

5. An exerciser as in claim 1 wherein said upper body pivot is connected to the underside of said seat.

6. An exerciser as in claim 1 wherein said upper body pivot is connected to the back of said seat.

7. An exerciser as in claim 1, and further including a back support attached to said frame.

8. An exerciser as in claim 1 wherein said downward pivoting movement of the seat in response to said pushing force applied to said upper body arm results from the orientation of the seat pivot and upper body arm pivot in respect to said seat.

9. An exerciser as in claim 1, further comprising a back support attached to said frame at a back support pivot point.

10. An exerciser as in claim 1, further comprising a moving leverage point that provides resistance to said upper body arm but does not constrain the range of motion of said upper body arm.

11. An exerciser comprising:

a seat;

a frame adapted to support said seat in a position above a floor;

a seat pivot pivotably connecting said seat and frame, said pivot located under said seat;

an upper body arm adapted to engage the upper body of a user;

an upper body arm pivot pivotably connecting said seat and said upper body arm;

a lower body arm adapted to engage the lower body of a user, said lower body arm attached to said seat;

a moving leverage point that engages said upper body arm but allows said upper body arm to rotate in the upper body arm pivot; and a leverage bar attached to said upper body arm and a constraint mechanism adapted to constrain movement of said leverage bar with respect to said frame in at least one direction while not constraining movement in another direction; wherein said constraint mechanism comprises a first roller and a second roller, and said leverage bar is movably trapped between said first roller and said second roller.

12. An exerciser comprising:

a pivoting seat;

a seat bracket, attached to and directly under the pivoting seat;

a first pivot point in the seat bracket, the first pivot point directly under the pivoting seat;

a pivot bar, attached through the first pivot point;

a first leg having a first leg cylinder, the first leg cylinder attached on the pivot bar;

a second leg having a second and third leg cylinder, the second and third leg cylinder attached on the pivot bar;

a left and right arm forming an arms/leverage bar;

support frame which includes the first and second leg, which holds the pivoting seat and provides a leverage point for the arms/leverage bar;

a leg raise assembly, including a lower body arm, fastened to the pivoting seat;

an upper body arm/leverage bar assembly including the arms/leverage bar that fastens to the pivoting seat at a second pivot point in the seat bracket under the pivoting seat;

an adjustment assembly for adjustment of the arms/leverage bar to provide for different body sizes;

a back support, wherein the upper body arm is adapted to engage the upper body of the user and a lower body arm is a structure adapted to engage the lower body of the user; and a moving leverage point, including a roller constraint mechanism which include a first and second roller.

13. The exerciser of claim 1 wherein the first and second roller are in direct contact with the leverage bar.

14. The exerciser of claim 1 wherein the upper body arm is pivotally connected directly under the seat.

15. The exerciser of claim 1 wherein the leverage bar is pivotally connected directly under the seat.

16. The exerciser of claim 1 wherein the upper body arm and the leverage bar are pivotally connected directly under the seat at the same pivot point.

17. The exerciser of claim 1 wherein the first roller and the second roller are connected to the frame using a first pin and a second pin.

18. The exerciser of claim 1, further comprising an adjustment assembly interconnected with the upper body arm and the leverage bar, wherein the adjustment assembly controls the angle between the upper body arm and the leverage bar.

19. The exerciser of claim 18 wherein the adjustment assembly includes a first bracket having first adjustment holes, a second bracket having a second adjustment hole, and an adjustment knob having a pin that passes through one of the first adjustment holes into the second adjustment hole.

* * * * *